US007295112B2

(12) United States Patent
Bowser et al.

(10) Patent No.: US 7,295,112 B2
(45) Date of Patent: Nov. 13, 2007

(54) INTEGRAL SECURITY APPARATUS FOR REMOTELY PLACED NETWORK DEVICES

(75) Inventors: Robert Bowser, Copley, OH (US); David Theobold, Akron, OH (US)

(73) Assignee: Cisco Technology, Inc., San Jose, CA (US)

( * ) Notice: Subject to any disclaimer, the term of this patent is extended or adjusted under 35 U.S.C. 154(b) by 193 days.

(21) Appl. No.: 11/098,251

(22) Filed: Apr. 4, 2005

(65) Prior Publication Data

US 2006/0220850 A1 Oct. 5, 2006

(51) Int. Cl.
*G08B 13/14* (2006.01)

(52) U.S. Cl. ..... 340/568.1; 340/687; 726/4; 726/26; 726/35

(58) Field of Classification Search ..... None
See application file for complete search history.

(56) References Cited

U.S. PATENT DOCUMENTS 4,337,462 A * 6/1982 Lemelson ..... 340/568.1
4,897,630 A * 1/1990 Nykerk ..... 340/426.25
5,675,321 A * 10/1997 McBride ..... 340/568.2
5,748,084 A * 5/1998 Isikoff ..... 340/568.1
5,801,628 A * 9/1998 Maloney ..... 340/568.2
5,963,131 A * 10/1999 D'Angelo et al. ..... 340/568.1
6,501,380 B1 * 12/2002 Jakobsson ..... 340/571
6,650,622 B1 * 11/2003 Austerman et al. ..... 370/241
6,946,960 B2 * 9/2005 Sisson et al. ..... 340/540
6,970,095 B1 * 11/2005 Lee et al. ..... 340/669
2002/0014962 A1 * 2/2002 Miglioli et al. ..... 340/571

* cited by examiner

*Primary Examiner*—Benjamin C. Lee
(74) *Attorney, Agent, or Firm*—Tucker Ellis & West LLP

(57) ABSTRACT

Integral electronic security is provided for a remotely placed network device to reduce the risk of theft, vandalism, or tampering. Sensors monitor the environment surrounding the remotely placed network device. When tampering is detected, a message is sent to a monitoring station. Optionally, the network device can clear its own configuration to prevent the loss of sensitive data.

24 Claims, 5 Drawing Sheets

INTEGRAL SECURITY APPARATUS FOR REMOTELY PLACED NETWORK DEVICES

BACKGROUND OF THE INVENTION

The present invention relates generally to a system and method for providing security and more specifically to an integral electronic security apparatus adapted to be placed within a remotely placed network device to reduce the risk of theft, vandalism, or other tampering.

Remotely placed network devices (such as access points, routers or other computing equipment) incur a risk of theft, vandalism or tampering when placed in areas of limited physical security or monitoring. Such hostile environments could include, but are not limited to, schools or public locations such as those locations suitable for wireless network access but with limited monitoring or physical security.

Presently available security systems provide for physical security of the network device. They typically provide mechanisms for physically securing the network device, e.g., locking devices. However, the presently available systems do not provide for integral electronic security.

BRIEF SUMMARY OF THE INVENTION

In accordance with an aspect of the present invention, the present invention in a preferred embodiment utilizes one or more sensors to be integrated or attached to a remotely placed network device for providing electronic security to that device. Placing a network device in a remote location incurs risk to both the value of the device and also to sensitive configuration information contained within that network device, such as encryption keys. Monitoring the immediate environment around the network device allows a system administrator to identify a threat prior to theft, vandalism, or other tampering. A feature of this apparatus is that early warning of an attack is provided and/or trend identification can be produced for scenarios wherein a criminal scopes out an attack ahead of time.

One aspect of the present invention described herein is an apparatus for providing electronic security to a network device. The apparatus comprises a sensor and a signal conditioning module comprising logic for processing a signal sent by the sensor, wherein the signal is indicative of tampering. A motherboard comprising a central processing unit is responsive to the signal conditioning module receiving the signal indicative of tampering to send a message to a monitoring device. The present invention further contemplates a computer-readable medium of instructions and method for performing aspects of the present invention.

Still other objects of the present invention will become readily apparent to those skilled in this art from the following description wherein there is shown and described a preferred embodiment of this invention, simply by way of illustration of one of the best modes best suited for to carry out the invention. As it will be realized, the invention is capable of other different embodiments and its several details are capable of modifications in various obvious aspects, all without departing from the invention. Accordingly, the drawing and descriptions will be regarded as illustrative in nature and not as restrictive.

BRIEF DESCRIPTION OF THE SEVERAL VIEWS OF THE DRAWING

The accompanying drawings incorporated in and forming a part of the specification illustrate several aspects of the present invention, and together with the description serve to explain the principles of the invention.

DETAILED DESCRIPTION OF INVENTION

Figure 1:
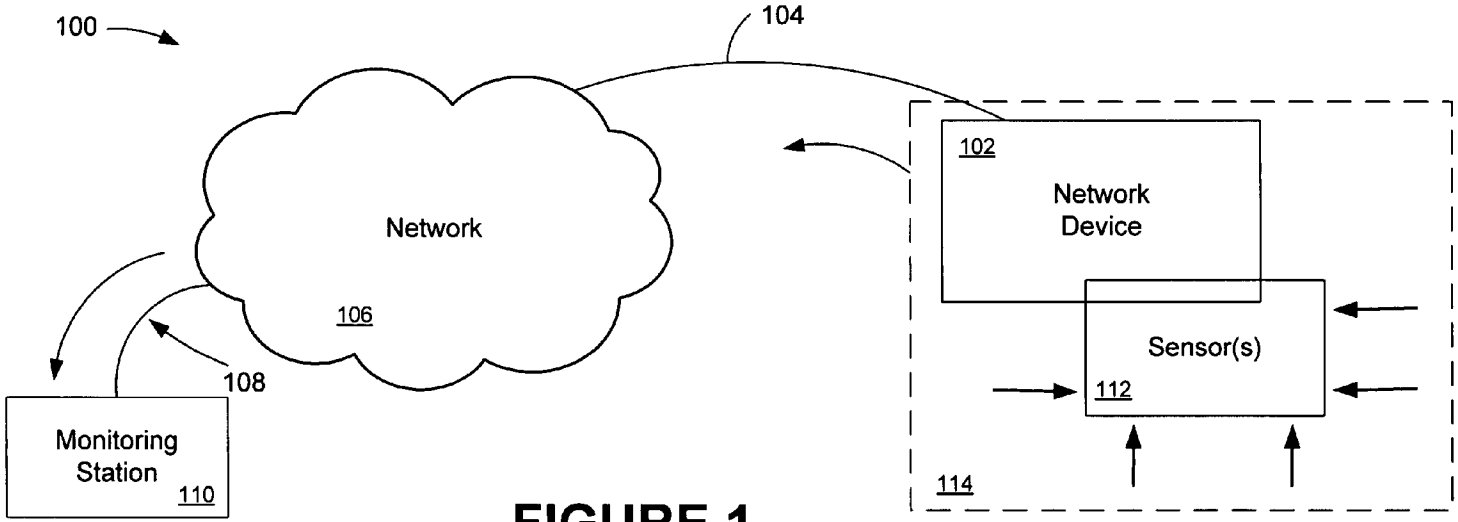
FIG. 1 is a block diagram of a system incorporating an aspect of the present invention.

Throughout this description, the preferred embodiment and examples shown should be considered as exemplars, rather than limitations, of the present invention. An aspect of the present invention is the use of a sensor or a suite of sensors to be integrated or attached to a remotely placed network device for the purpose of providing electronic security to that device. Technologies that can be employed for protecting a remote network device include, but are not limited to:

near (or far) field motion detection through the use of passive infrared detectors;

near field presence detection of an object through the use of a retro-reflective sensor;

shock and vibration detection by acoustic sensors or accelerometers;

attitude change detected by clinometers or other orientation sensors;

detection of mounting plate removal from a mounting surface by a lever switch;

detection of network device removal from a mounting plate by a lever switch; and detection of a human body through the application of field sensor technology.

The present invention can employ an apparatus (e.g., a card that can be plugged into a slot of the device or an ASIC) for interfacing with the sensors. The sensors can be coupled to the apparatus or directly mounted on the apparatus. The apparatus could be included into the circuitry of the network device, or it could interface with an existing circuit on the network device using established interfaces, such as console, card bus, MPCI, IIC bus, PCI or PCIe bus. The apparatus can be produced in a modular fashion, allowing the same design for a network device to be marketed with or without the electronic security option.

Logic within the apparatus polls the connected sensors and reports activity to the host CPU of the network device. In a preferred embodiment, the host CPU polls the apparatus. Sensor signal conditioning, such as input de-bounce, digitizing, and threshold adjustment is included in the apparatus. "Logic", as used herein, includes but is not limited to hardware, firmware, software and/or combinations of each to perform a function(s) or an action(s), and/or to cause a function or action from another component. For example, based on a desired application or need, logic may include a software controlled microprocessor, discrete logic such as an application specific integrated circuit (ASIC), a programmable/programmed logic device, memory device containing instructions, or the like, or combinational logic embodied in hardware. Logic may also be fully embodied as software.

Sensor activity is reported to a monitoring station over one or more network interfaces on the network device. Possible protocols for reporting sensor activity include but are not limited to SNMP (Simple Network Management Protocol) and SNMP traps. In an alternative embodiment, a similar management capable network is used. Preferably, the protocol used for reporting sensor activity has heartbeat like keep-alive messaging and supports both solicited and unsolicited communications.

An aspect of the apparatus reduces the risk of losing a network device or confidential information contained within the network device that is typically incurred when placing a network device in an unsecured location. The protection provided by the apparatus depends on the selected suite of sensors employed. For example, an infrared retro-reflective sensor configured to detect the presence of an object within a predetermined distance from the network device (for example an access point) could be implemented on either the motherboard of the network device or on the apparatus. The apparatus comprises logic for conditioning the signal from the sensor to compensate for the effects of ambient lighting. For example, an access point can have sensors embedded in its cover. Often, the cost of the electronic security is less than the cost of providing physical security and can eliminate the need for a high physical security enclosure for the network device.

In at least one embodiment, the present invention is implemented with a self inhibit mode that has a network device clear its own configuration when the network device detects tampering. In this mode, any sensitive configuration information contained within the network device would be erased from non-volatile memory if intrusion is detected. This feature is particularly useful in applications where the device is not actively monitored or where large deployments would be impacted by the loss of sensitive configuration information, such as network keys employed by the device. When servicing is required for a device using this mode, a message can be sent through the network to the device by a network administrator to disable the protection. Alternatively, the device can clear its memory while it is being serviced, and when it re-connects to the network re-obtain its credentials from a server or other device on the network after it has been authenticated, (e.g., self configuring).

FIG. 1 is a block diagram of a system 100 incorporating an aspect of the present invention. System 100 comprises a network device 102 being protected in accordance with an aspect of the present invention. Network device 102 comprises logic for performing the functionality described herein.

Network device 102 is connected along path 104 to network 106. Path 102 is suitably any wired network, wireless network, or combination of wired and wireless topology. Similarly, network 106 is suitably any type of network, such as a Local Area Network (LAN), Ethernet, Internet, or even a combination of several topologies. Monitoring station 110 is connected to network 106 along path 108, which is suitably any wired network, wireless network, or combination of wired and wireless topology.

Sensors 112 are coupled to network device 102. Sensors 112 monitor the environment 114 around network device 102. Sensors 112 are suitably capable of one or more of near (or far) field motion detection through the use of passive infrared detectors, near field presence detection of an object through the use of a retro-reflective sensor, shock and vibration detection with tilt switches, accelerometers or both, detection of mounting plate removal from a mounting surface employing a lever switch, detection of network device removal from a mounting plate using a lever switch, and detection of a human body through the application of field sensor.

As sensors 112 detect conditions around environment 114, which may be a hostile or un-monitored environment, the conditions are reported to network device 102. Network device 102 is configured to send reports to monitoring station 110 along path 104 through network 106 and path 108. Network device 102 can be configured to send reports periodically, be polled by monitoring station 110 to send reports, immediately send reports when an alarm condition exists, or any combination thereof.

For example, as sensors 112 detect an event such as a body or object within a certain distance of network device 102, a signal is sent from sensors 112 to network device 102, which in response to the signal sends a message to monitoring station 110. This can enable personnel at monitoring station 110 to investigate the cause of the event by monitoring nearby video cameras (not shown) or sending someone to the area of network device 102 to investigate. A potential benefit of this feature is that early warning of an attack is provided and/or trend identification can be produced for scenarios wherein a criminal scopes out an attack ahead of time.

In addition, or in the alternative, to sending a message when an event is detected by sensor 112, logic in network device 102 is configured to respond to an event by deleting data from its non-volatile memory (not shown). The data includes configuration data for the network device, such as network secrets, including but not limited to an encryption (cryptographic) key used by the network device to communicate on network 106.

In addition, network device 102 can set multiple levels of alarms, taking different actions depending upon the level of the alarm. For example, a first alarm level is set when an infrared detector or retro-reflective sensor detects an object or anomaly within a preset distance of network device 102, preferably within environment 114. Responsive to the first alarm level, network device 102 sends a message across network 106 to monitoring station 110 reporting the event. Subsequently, if additional events are detected that are indicative of tampering with network device 102, such as shock and vibration detection, detection of mounting plate removal, detection of network device removal from a mounting plate by a lever switch or any combination thereof, logic in network device 102 is responsive to delete data from its non-volatile memory.

Figure 2:
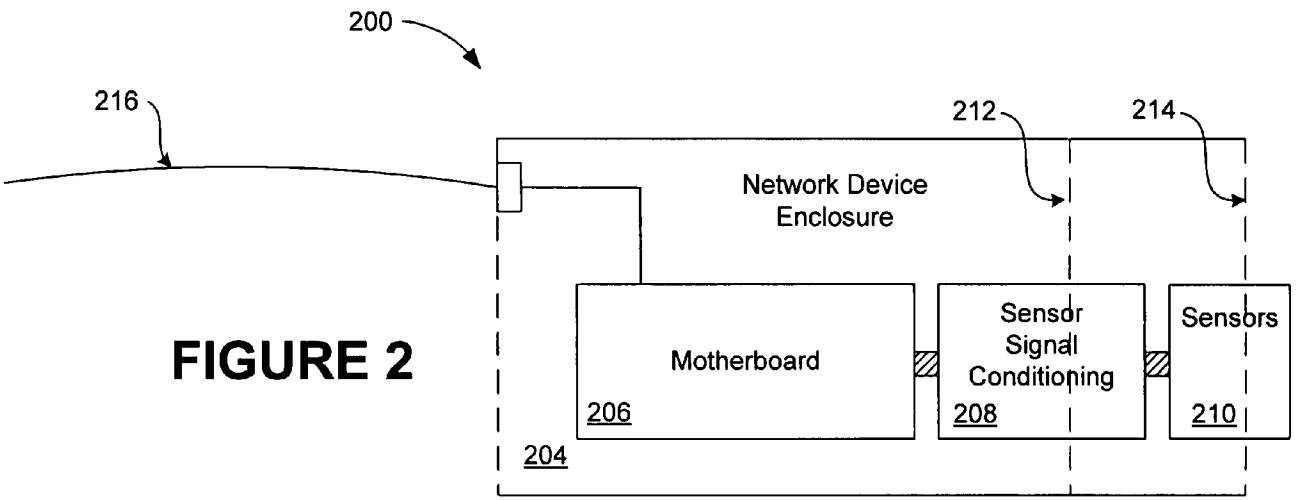
FIG. 2 is a block diagram of a network device configured in accordance with an aspect of the present invention.

FIG. 2 is a block diagram of a network device 200 configured in accordance with an aspect of the present invention. The configuration of network device 200 is suitable for use with network device 102 of FIG. 1. As shown, network device 200 has an enclosure 204 containing a motherboard 206. Motherboard 206 includes logic for the network device to function, as well as the logic for implementing an aspect of the present invention. For example, if network device 200 is a wireless LAN access point, then motherboard 206 comprises the physical (PHY) layer and Media Access Control (MAC) Layer processors, as well as logic for performing an aspect of the present invention.

Motherboard 206 is coupled to sensor signal conditioning module 208, which is coupled to sensors 210. Sensor signal conditioning module 208 comprises logic for receiving signals from sensors 210 and performing signal conditioning functions. For example, depending on the embodiment, signal conditioning module 208 would have logic to perform one or more de-bouncing, digitizing, threshold level comparing, analog to digital converting, calibrating, etc. For example, if one of the sensors 210 of network device 200 is an infrared sensor, signal conditioning module 208 determines from the properties of the signal, such as the strength or the reflected angle of the signal, whether the infrared sensor is detecting something significant. If signal conditioning module 208 determines that the infrared sensor is detecting something significant, it sends a signal to motherboard 206. Logic in motherboard 206 would determine how to respond to the event.

In a preferred embodiment, sensors 210 comprise a plurality of sensors. For example an infrared, field sensor or retro-reflective sensors used in conjunction with a tilt switch, an accelerometer, or a lever switch. This is useful for generating multi-level alarms. For example, when an infrared, field sensor or retro-reflective sensor detect motion or a body near network device 200, sensor signal conditioning module 208 receives the data from sensors 210, which is forwarded to motherboard 206. Logic in motherboard 206 can determine that a first alarm condition has been reached, e.g, a suspicious event, but not necessarily a critical event. This may allow for early warning of an attack and/or trend identification, which is particularly useful for scenarios wherein a criminal scopes out an attack ahead of time. Logic in motherboard 206 sends a message along network connection 216 to another device (not shown) in the network, such as a monitoring station 110 as shown in FIG. 1. Optionally, logic in motherboard 206 is further responsive to the event to log the event. However, when one or more of a tilt switch, an accelerometer and lever switch of sensors 210 detects physical tampering of the device (that is potentially network device 200 is being removed) sensor signal conditioning module 208 passes this information to motherboard 206. Logic in motherboard 206 determining the condition is a critical event, e.g., the device is being removed, determines a higher priority (critical) alarm event has accord and responds by one or more of sending another, and possibly more urgent, message on network connection 216 and deleting sensitive data from non-volatile memory, such as encryption (cryptographic) key data. However, in a multi-level alarm type configuration, it should be noted that the alarms do not necessarily have to occur in any particular order such as by level. For example, if no lower level alarm event has occurred, if a critical event is detected, for example a lever switch detects the network device is being removed from its mounting plate, the logic on motherboard 206 is responsive to immediately send a message reporting the event and deleting sensitive data from non-volatile memory.

In accordance with an aspect of the present invention, if network device 200 needs field servicing, the alarm system can be temporarily disabled. For example, a message can be sent to network device 200 that is received on network connection 216. Such a message can be sent by a monitoring station such as monitoring station 110 in FIG. 1. In an alternative embodiment, if the network device 200 is a self-configuring device, for example it can obtain its network configuration parameters via network connection 216 after authenticating (preferably mutually authenticating) with an authentication server, then network device 200 can delete the sensitive data from its non-volatile memory while its being serviced. After servicing is completed, when network device 200 is re-connected to its network, it re-authenticates and obtains its operating parameters.

In one embodiment, the location of sensor signal conditioning module 208 is inside network device enclosure 204, e.g., network device enclosure 204 extends to line 214. For example, sensor signal conditioning module 208 can be mounted on a card in an expansion slot within network device 200. As another example, sensor signal conditioning module 208 could be located on a component of network device 200, such as the motherboard 206 being located in a main section and sensor signal conditioning module 208 located on a detachable section, such as a device cover. If sensor signal conditioning module 208 is located on a detachable section such as a device cover, sensors 210 may also be located on the same detachable section.

In another embodiment, some, or all, of sensor signal conditioning module 208 is external to network device enclosure 204, e.g, network device enclosure extends as far as line 212. For example, sensor signal conditioning module 208 can be plugged into an available slot, such as a cardbus, PCI, or PCIe slot. Alternatively, sensor signal conditioning module 208 can be completely external from network device 200 and coupled to it using a wired or wireless communication means such as infrared, serial data, or USB.

Regardless of the placement of sensor signal conditioning module 208, sensor signal conditioning module 208 is between motherboard 206 and sensors 210. This reduces the load on any processors on motherboard because logic on sensor signal conditioning module 208 performs signal conditioning and does not disturb motherboard 206 unless predetermined criteria are met. Thus, motherboard 206 does not have to constantly monitor sensors 210. Motherboard 206 may poll sensor signal conditioning module 208 at periodic intervals, or alternatively, sensor signal conditioning module 208 can generate an interrupt or perform direct memory transfer, or any type of data transfer when sensors 210 detect an event.

Figure 3:
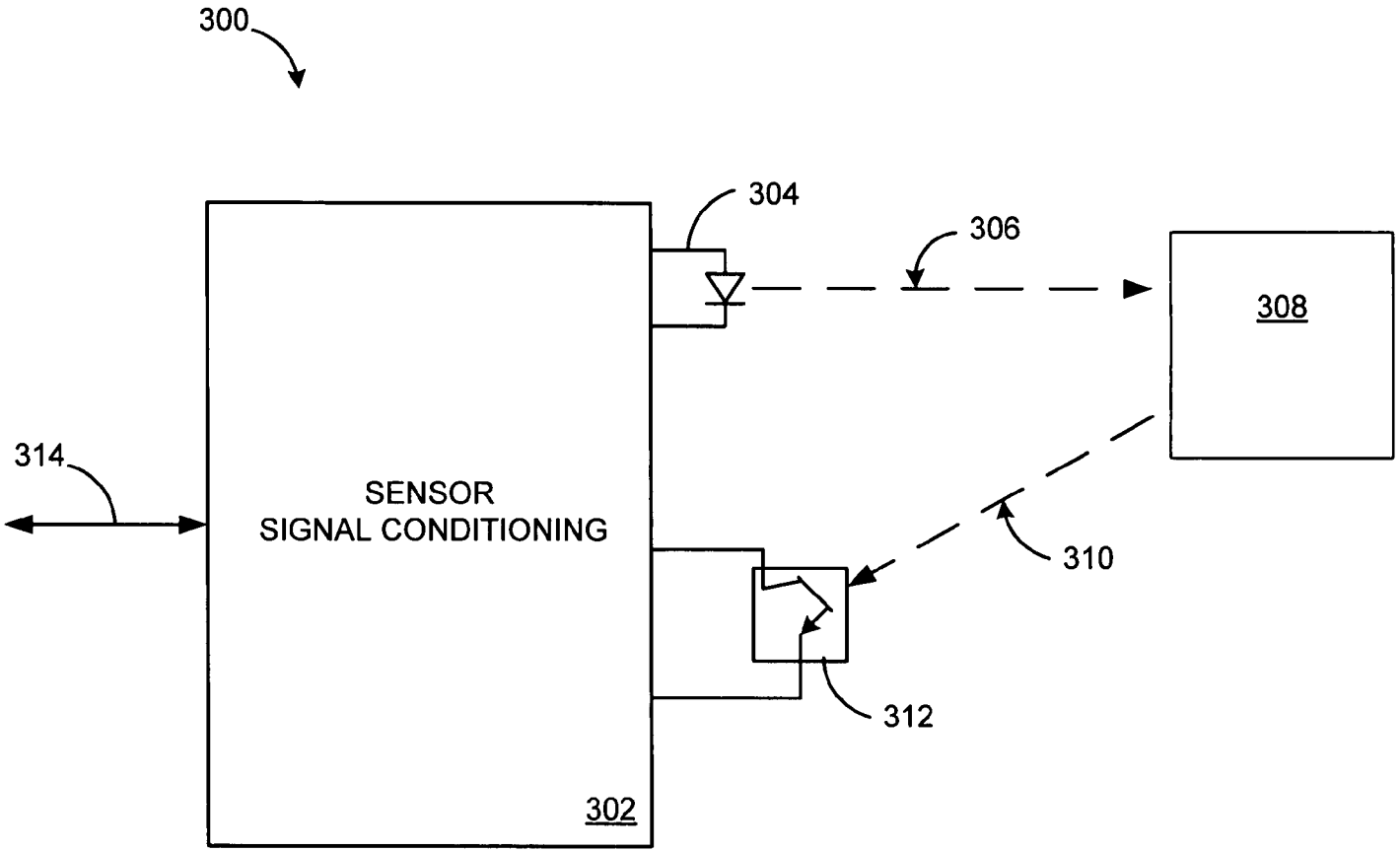
FIG. 3 is a block diagram of a sensor signal conditioning module.

FIG. 3 is a block diagram of system 300 employing a sensor signal conditioning module 302 in accordance with an aspect of the present invention. A light emitting diode (LED) 304 produces an infrared (IR) beam 306. Beam 306 bounces off a suspect object 308, and a reflected signal 310 is received by optical transistor 312. Logic within sensor signal conditioning module 302 determines from reflected signal 310 the distance of the suspect object 308. If the object is within a predetermined distance, then it sends a message along bi-directional interface 314 to the network device, for example a network device such as network device 102 in FIG. 1, or to the motherboard 206 of a network device 200 as illustrated in FIG. 2. Logic in sensor signal conditioning module 302 can be configured to immediately send the message on bi-directional interface 314, or wait until a poll or other indication that the network device is ready to receive a message is received on bi-directional interface 314.

In a preferred embodiment sensor signal conditioning module 302 is tuned so that it does not send messages to the network device unless the suspect object is within a predetermined range. Furthermore, sensor signal conditioning module 302 can be tuned to filter out ambient light or other environmental conditions. Also, signal conditioning module 302 can be tuned so that a signal is not sent based on the distance and the time an object is within that distance. For instance, if an object is ten feet away for less than a half a second, then sensor signal conditioning module 302 does not send a message, but if the object stays within ten feet for more than a half a second a message is sent. Furthermore, if the object moves within a close distance, e.g., five feet, the time period could be set shorter, e.g., a quarter of a second. From the foregoing, those skilled in the art can readily appreciate that signal sensor signal conditioning module 302 is flexible enough to be configured for a wide variety of environmental conditions.

Figure 4:
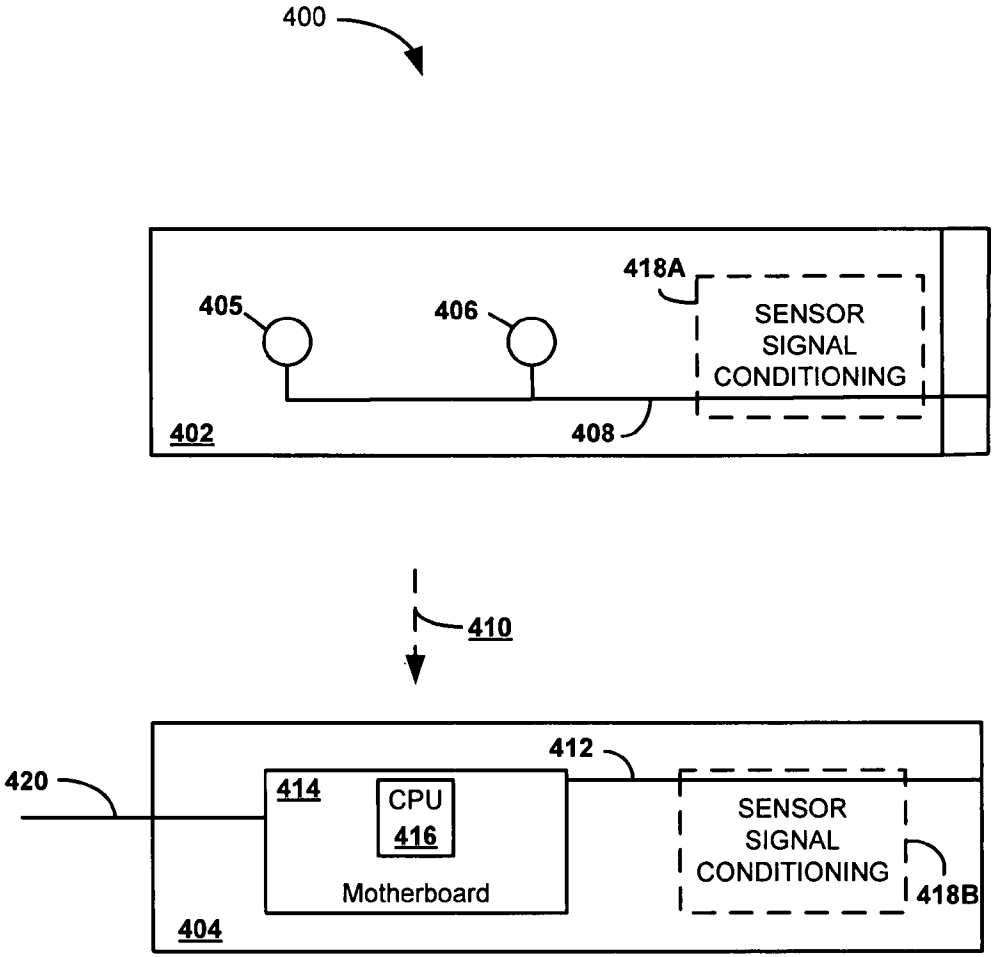
FIG. 4 is an isometric diagram of a network device configured in accordance with an aspect of the present invention.

FIG. 4 is an isometric diagram of a network device 400 configured in accordance with an aspect of the present invention. As shown, network device has a top portion 402 and a bottom portion 404. Top portion 402 comprises sensors 405 and 406. A conductor 408 is used to carry signals from sensors 405 and 406. Bottom portion 404 comprises a motherboard 414 and a central processing unit (CPU) 416. Conductor 412 is used to transmit and receive signals from motherboard 414. As illustrated, when the top portion 402 is moved, e.g, as shown by path 410, to engage the bottom portion 404, conductors 408 and 412 are configured to engage each other, thereby forming a conductive path between sensors 406 and motherboard 414 so that signals may be exchanged between them. The sensor signal conditioning module can be located either on the top portion 402, for example at location 418A or on the bottom portion 404, for example at location 418B.

In operation, signals from sensors 405 and 406 are sent to the sensor signal conditioning module. If the sensor signal conditioning module is located on top portion 402, then the signal is transmitted along conductor 408 to the sensor signal conditioning module at location 418A, otherwise the signal is conducted along conductor 408 to conductor 412 to the sensor signal conditioning module at location 418B. The sensor signal conditioning module processes the signals from the sensor, and if it determines that a signal should be sent to motherboard 414, the signal is sent along conductor 412 to motherboard 414. Motherboard 414 can be configured to forward the signal onto network interface 420, or motherboard 414 can be configured so that CPU 416 processes the signal and decided whether to send a message on network interface 420.

Figure 5:
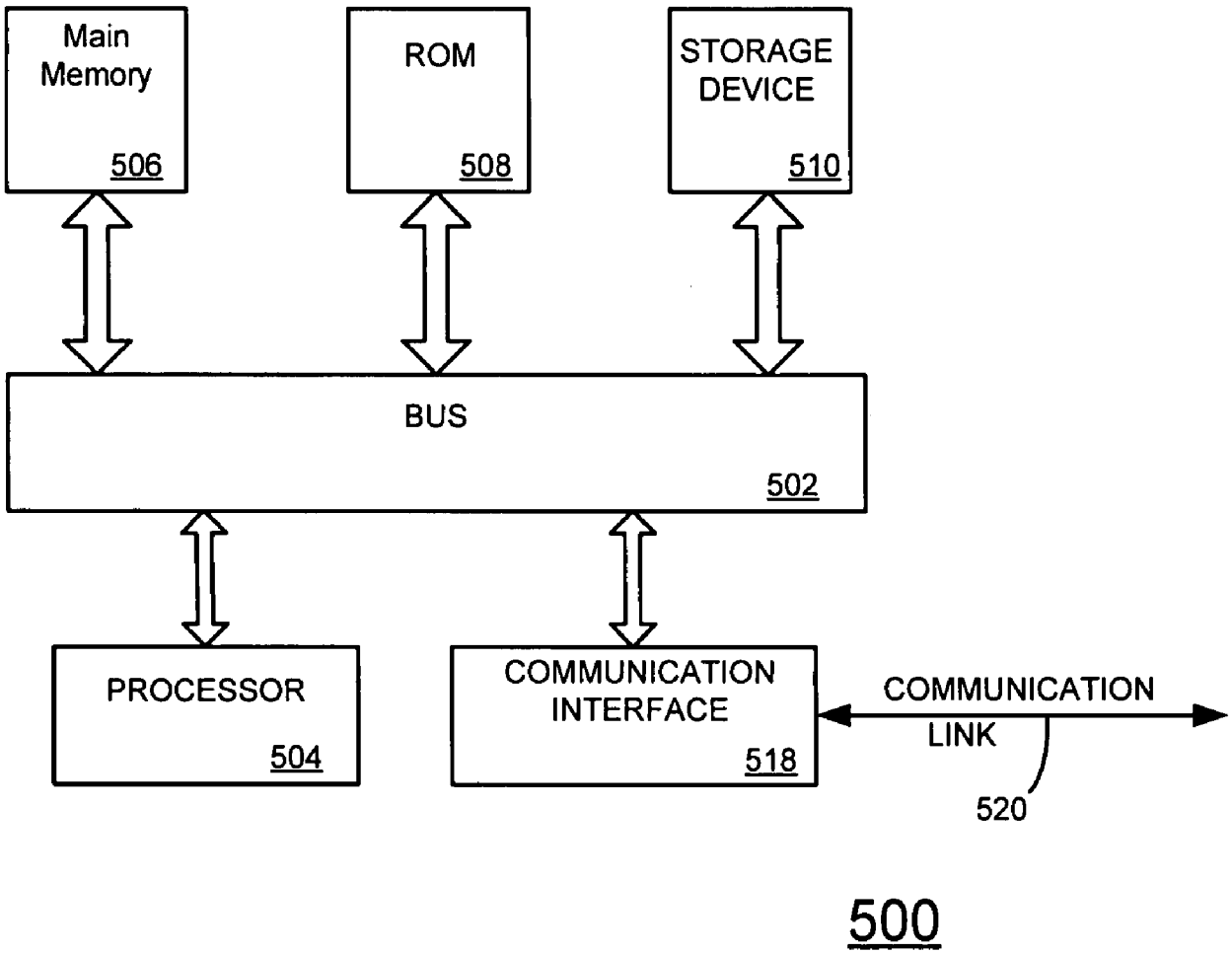
FIG. 5 is a block diagram of a computer system for implementing an aspect of the present invention.

FIG. 5 is a block diagram of a computer system 500 upon which an embodiment of the invention may be implemented. Computer system 500 is suitably adapted to be employed in a network device, e.g., network device 102 in FIG. 1, 200 in FIG. 2, or 400 in FIG. 4, or configured to function as a motherboard, such as motherboard 206 in FIG. 2 or motherboard 414 in FIG. 4, or can be employed to function as a sensor signal conditioning module, such as sensor signal conditioning module 208 in FIG. 2 or sensor signal conditioning module 302 in FIG. 3.

Computer system 500 includes a bus 502 or other communication mechanism for communicating information and a processor 504 coupled with bus 502 for processing information. Computer system 500 also includes a main memory 506, such as random access memory (RAM) or other dynamic storage device coupled to bus 502 for storing information and instructions to be executed by processor 504. Main memory 506 also may be used for storing a temporary variable or other intermediate information during execution of instructions to be executed by processor 504. Computer system 500 further includes a read only memory (ROM) 508 or other static storage device coupled to bus 502 for storing static information and instructions for processor 504. A storage device 510, such as a magnetic disk or optical disk, is provided and coupled to bus 502 for storing information and instructions.

The invention is related to the use of computer system 500 for an integral security apparatus for remotely placed network devices. According to one embodiment of the invention, one or more components of the integral security apparatus for remotely placed network devices is provided by computer system 500 in response to processor 504 executing one or more sequences of one or more instructions contained in main memory 506. Such instructions may be read into main memory 506 from another computer-readable medium, such as storage device 510. Execution of the sequence of instructions contained in main memory 506 causes processor 504 to perform the process steps described herein. One or more processors in a multi-processing arrangement may also be employed to execute the sequences of instructions contained in main memory 506. In alternative embodiments, hard-wired circuitry may be used in place of or in combination with software instructions to implement the invention. Thus, embodiments of the invention are not limited to any specific combination of hardware circuitry and/or software.

The term "computer-readable medium" as used herein refers to any medium that participates in providing instructions to processor 504 for execution. Such a medium may take many forms, including but not limited to non-volatile media, volatile media, and transmission media. Non-volatile media include for example optical or magnetic disks, such as storage device 510. Volatile media include dynamic memory such as main memory 506. Transmission media include coaxial cables, copper wire and fiber optics, including the wires that comprise bus 502. Transmission media can also take the form of acoustic or light waves such as those generated during radio frequency (RF) and infrared (IR) data communications. Common forms of computer-readable media include for example floppy disk, a flexible disk, hard disk, magnetic cards, paper tape, any other physical medium with patterns of holes, a RAM, a PROM, an EPROM, a FLASHPROM, any other memory chip or cartridge, a carrier wave as described hereinafter, or any other medium from which a computer can read.

Various forms of computer-readable media may be involved in carrying one or more sequences of one or more instructions to processor 504 for execution. For example, the instructions may initially be borne on a magnetic disk of a remote computer. The remote computer can load the instructions into its dynamic memory and send the instructions over a telephone line using a modem. A modem local to computer system 500 can receive the data on the telephone line and use an infrared transmitter to convert the data to an infrared signal. An infrared detector coupled to bus 502 can receive the data carried in the infrared signal and place the data on bus 502. Bus 502 carries the data to main memory 506 from which processor 504 retrieves and executes the instructions. The instructions received by main memory 506 may optionally be stored on storage device 510 either before or after execution by processor 504.

Computer system 500 also includes at least one communication interface 518 coupled to bus 502. Communication interface 518 provides a two-way data communication coupling to a communication link 520. Communication link 520 can suitably be connected to a local area network (LAN), or any other type of bi-directional communication interface such as a PCI or PCIe bus, or a USB port. Wireless links may also be implemented. In any such implementation, communication interface 518 sends and receives electrical, electromagnetic, or optical signals that carry digital data streams representing various types of information.

Communication link 520 typically provides data communication through one or more networks to other data devices. For example, communication link 520 can be employed by network device 102 to communicate with monitoring station 110 in FIG. 1. As another example, communication link can be used by signal conditioning module 208 to either communicate with sensors 210 or motherboard 206 in FIG. 2, or a first communication link is used to communicate with sensors 210 and a second communication link is used to communicate with motherboard 206.

Computer system 500 can send messages and receive data, including program codes, through the network(s), communication link 520, and communication interface 518. For example, an external device (not shown) such as a server might transmit a requested code for an application program through communication link 520 and communication interface 518. In accordance with the invention, one such downloaded application provides for implementing an integral security apparatus for remotely placed network devices as described herein.

The received code may be executed by processor 504 as it is received, and/or stored in storage device 510, or other non-volatile storage for later execution. In this manner, computer system 500 may obtain application code in the form of a communicated data set.

Figure 6:
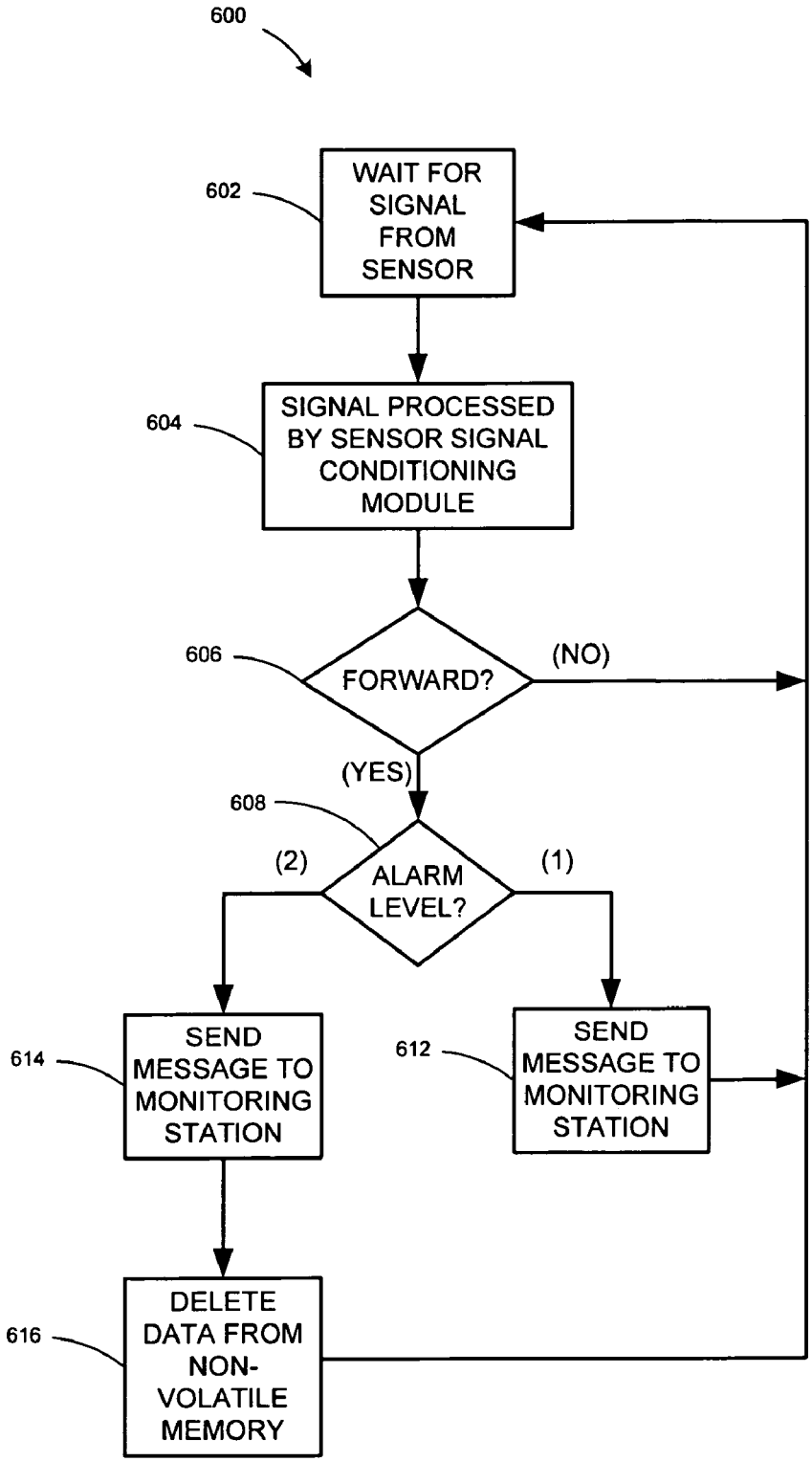
FIG. 6 is a flow diagram of a methodology in accordance with an aspect of the present invention.

In view of the foregoing structural and functional features described above, a methodology in accordance with various aspects of the present invention will be better appreciated with reference to FIG. 6. While, for purposes of simplicity of explanation, the methodology of FIG. 6 is shown and described as executing serially, it is to be understood and appreciated that the present invention is not limited by the illustrated order, as some aspects could, in accordance with the present invention, occur in different orders and/or concurrently with other aspects from that shown and described herein. Moreover, not all illustrated features may be required to implement a methodology in accordance with an aspect the present invention. Embodiments of the present invention are suitably adapted to implement the methodology in hardware, software, or a combination thereof.

FIG. 6 is a flow diagram of a methodology 600 in accordance with an aspect of the present invention. The methodology illustrates an example implementation of an integral security apparatus for remotely placed network devices.

At 602, the methodology 600 waits for a signal from a sensor. The sensor may be any type of sensor, including but not limited to the types of sensors described herein. The sensors can be coupled to the remotely placed network device or directly mounted on the remotely placed network device.

When a signal is received from a sensor, then at 604, the signal is processed by a sensor signal conditioning module. The sensor signal conditioning module performs one or more of de-bouncing, digitizing, threshold comparing and threshold adjusting. For example, in the case of a sensor which detects near or far motion, the signal conditioning module determines the distance of the object detected by the sensor from the remotely placed network device. Logic within the sensor signal conditioning module determines when an alarm event has occurred based on signals received from one or more sensors. For example, if an object is within a predetermined distance, then an alarm event has occurred. Alternatively, the sensor signal conditioning module can determine that an alarm event has occurred if the object remains within a predetermined distance for more than a preset time. For example, an object ten feet away may not be considered an alarm event unless it has been there more than five seconds, whereas an object five feet away may be considered an alarm event if it has been there more than two seconds, or an object may be considered an alarm event anytime it is less than two feet away from the remotely placed network device.

At 606, it is determined whether the sensor signal conditioning module has detected an alarm event. If an alarm event was not detected (NO), then processing returns to wait for another signal from a sensor at 602. If an alarm event was detected (YES), then at 608 it is determined what level of alarm has been received. Although FIG. 6 only shows two levels of alarm (1) and (2), those skilled in the art can readily appreciate that any number of suitable levels can be used. However, for implementations using only one level of alarm, 608 is skipped and the appropriate action for the alarm is executed.

As illustrated in FIG. 6, if at 608 it is determined that the alarm is at a first level (1), a message is sent by the network device to the monitoring station at 612. This is an exemplary action only, as the present invention is suitably adaptable to execute any appropriate action. After the message is sent, then processing returns to 602 to wait for another signal from a sensor.

As illustrated in FIG. 6, if at 608 it is determined that the alarm is at a second level (2), a message is sent by the network device to the monitoring station at 614. Additionally, at 616, data from non-volatile memory is erased. Any sensitive configuration information contained within the network device would be erased from non-volatile memory. This feature is particularly useful in applications where the device is not actively monitored or where large deployments would be impacted by the loss of sensitive configuration information, such as network keys employed by the device. After the message is sent and the data in the non-volatile memory is erased, then processing returns to 602 to wait for another signal from a sensor.

A feature of using different alarm levels is that the network device can take different actions depending upon the level of the alarm. For example, the first alarm level is set when an infrared detector or retro-reflective sensor detects an object or anomaly within a preset distance of the network device. Responsive to the first alarm level, as shown at 612, the network device sends a message across the network to the monitoring station reporting the event. Subsequently, or alternatively, if additional or other events are detected that are indicative of tampering with network device, alarm level (2), such as shock and vibration detection, detection of mounting plate removal, detection of network device removal from a mounting plate by a lever switch or any combination thereof, the network device is responsive to send a message, as shown at 614 and to delete data from its non-volatile memory as shown at 616. The number of alarm levels and configurable responses is unlimited.

What has been described above includes exemplary implementations of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims interpreted in accordance with the breadth to which they are fairly, legally, and equitably entitled.

The invention claimed is:

1. An apparatus, comprising:

a sensor;

a signal conditioning module comprising logic for processing a signal sent by the sensor, the signal indicative of tampering; and a motherboard comprising a central processing unit responsive to the signal conditioning module receiving the signal indicative of tampering to send a message to a monitoring device;

wherein the central processing unit is responsive to determining that the central processing unit is coupled to a network to authenticate with an authentication server coupled to the network; and wherein the central processing unit is further responsive to maintenance requests, the central processing unit sending sensitive data to the network before the maintenance is performed and the central processing unit restoring the sensitive data when the maintenance is completed and after re-authentication.

2. An apparatus according to claim 1, wherein the signal conditioning module is located on the motherboard of the network device.

3. An apparatus according to claim 1, wherein the signal conditioning module is located between the sensor and the motherboard.

4. An apparatus according to claim 1, wherein the central processing unit is further responsive to the signal conditioning module to delete data from a non-volatile memory.

5. An apparatus according to claim 4, wherein the non-volatile memory contains configuration data for the network device.

6. An apparatus according to claim 5, wherein the configuration data comprises an encryption key used by the network device to communicate on the network.

7. An apparatus according to claim 5, wherein the central processing unit is responsive to multiple alarm levels, the central processing unit sending the message to the monitoring device responsive to a first alarm level and to delete data from the non-volatile memory responsive to a second alarm level.

8. An apparatus according to claim 1, wherein the sensor is at least one of the group consisting of a passive infrared detector;

a retro-reflective sensor;

a tilt switch;

an accelerometer;

a lever switch; and a field sensor for detecting a human body.

9. An apparatus according to claim 1, wherein the logic for processing a signal sent by the sensor comprises at least one of:

logic for de-bouncing the signal;

logic to digitize the signal; and logic to determine whether the signal has exceeded a predetermined threshold.

10. An apparatus according to claim 1, wherein the sensor reflects a signal off of a suspect object and wherein the conditioning module determines the suspect object distance from the apparatus.

11. An apparatus according to claim 10, wherein the signal conditioning module can be tuned so that a signal is sent based on the distance and time the suspect object is within a predetermined area.

12. An apparatus according to claim 1, wherein the central processing unit is further responsive to a plurality of the signals indicative of tampering over a time period, to send a message to a monitoring station to preemptively prevent an intrusion.

13. An apparatus, comprising:

a sensor;

a signal conditioning module comprising logic for processing a signal sent by the sensor, the signal indicative of tampering; and a motherboard comprising a central processing unit responsive to the signal conditioning module receiving the signal indicative of tampering to send a message to a monitoring device;

wherein the central processing unit is responsive to determining that the central processing unit is coupled to a network to authenticate with an authentication server coupled to the network; and wherein the central processing unit is further responsive to the signal indicative of tampering, the central processing unit sending sensitive data to the network, and when there is no further threat of tampering, restoring the sensitive data from the network.

14. An apparatus according to claim 13, wherein the signal conditioning module is located on the motherboard of the network device.

15. An apparatus according to claim 13, wherein the signal conditioning module is located between the sensor and the motherboard.

16. An apparatus according to claim 13, wherein the central processing unit is further responsive to the signal conditioning module to delete data from a non-volatile memory.

17. An apparatus according to claim 16, wherein the non-volatile memory contains configuration data for the network device.

18. An apparatus according to claim 17, wherein the configuration data comprises an encryption key used by the network device to communicate on the network.

19. An apparatus according to claim 17, wherein the central processing unit is responsive to multiple alarm levels, the central processing unit sending the message to the monitoring device responsive to a first alarm level and to delete data from the non-volatile memory responsive to a second alarm level.

20. An apparatus according to claim 13, wherein the sensor is at least one of the group consisting of a passive infrared detector;

a retro-reflective sensor;

a tilt switch;

an accelerometer;

a lever switch; and a field sensor for detecting a human body.

21. An apparatus according to claim 13, wherein the logic for processing a signal sent by the sensor comprises at least one of:

logic for de-bouncing the signal;

logic to digitize the signal; and logic to determine whether the signal has exceeded a predetermined threshold.

22. An apparatus according to claim 13, wherein the sensor reflects a signal off of a suspect object and wherein the conditioning module determines the suspect object distance from the apparatus.

23. An apparatus according to claim 22, wherein the signal conditioning module can be tuned so that a signal is sent based on the distance and time the suspect object is within a predetermined area.

24. An apparatus according to claim 13, wherein the central processing unit is further responsive to a plurality of the signals indicative of tampering over a time period, to send a message to a monitoring station to preemptively prevent an intrusion.

* * * * *